US007773755B2

(12) United States Patent
Terauchi et al.

(10) Patent No.: US 7,773,755 B2
(45) Date of Patent: Aug. 10, 2010

(54) REPRODUCTION APPARATUS AND REPRODUCTION SYSTEM

(75) Inventors: Toshiro Terauchi, Tokyo (JP); Yoichiro Sako, Tokyo (JP); Masayoshi Miura, Chiba (JP); Susumu Yabe, Tokyo (JP)

(73) Assignee: Sony Corporation, Tokyo (JP)

( * ) Notice: Subject to any disclaimer, the term of this patent is extended or adjusted under 35 U.S.C. 154(b) by 1243 days.

(21) Appl. No.: 11/198,175

(22) Filed: Aug. 8, 2005

(65) Prior Publication Data

US 2006/0060070 A1 Mar. 23, 2006

(30) Foreign Application Priority Data

Aug. 27, 2004 (JP) ..... 2004-248951

(51) Int. Cl.
*H04R 5/00* (2006.01)
*H04R 5/02* (2006.01)

(52) U.S. Cl. ..... 381/17; 381/18; 381/19; 381/303; 381/304

(58) Field of Classification Search ..... 381/61, 381/63, 17, 18, 19, 300, 303, 304, 310; 84/630
See application file for complete search history.

(56) References Cited

U.S. PATENT DOCUMENTS 5,761,315 A * 6/1998 Iida et al. ..... 381/18
6,175,872 B1 1/2001 Neumann et al.
2003/0028273 A1 2/2003 Lydecker et al.
2003/0164084 A1 9/2003 Redmann et al.
2003/0202667 A1* 10/2003 Sekine ..... 381/63
2003/0235318 A1* 12/2003 Bharitkar et al. ..... 381/304

FOREIGN PATENT DOCUMENTS

DE 31 42 462 A1 5/1982

(Continued)

OTHER PUBLICATIONS

Alastair Sibbald, "Transaural acoustic crosstalk cancellation", Sensaura, XP003010577, 2001, pp. 1-10.

(Continued)

*Primary Examiner*—Vivian Chin
*Assistant Examiner*—George C Monikang
(74) *Attorney, Agent, or Firm*—Oblon, Spivak, McClelland, Maier & Neustadt, L.L.P.

(57) ABSTRACT

A reproduction apparatus comprises an inverse characteristics converting section that converts the acoustic characteristics of an acoustic space into inverse characteristics thereof, a reproducing section that reproduces music data, an acoustic characteristics output section that outputs acoustic characteristics different from the acoustic characteristics of the acoustic space, an adjusting section that adjusts the music data reproduced by the reproduction section on the basis of the inverse acoustic characteristics of the acoustic space converted by the inverse characteristics conversion section and the acoustic characteristics output from the acoustic characteristics output section and an output section that outputs the music data adjusted by the adjustment section to the acoustic space.

18 Claims, 9 Drawing Sheets

FOREIGN PATENT DOCUMENTS

| | | | |
|---|---|---|---|
| EP | 0 276 948 | A2 | 8/1988 |
| EP | 1 341 399 | A2 | 9/2003 |
| EP | 1 571 884 | A2 | 9/2005 |
| JP | 2-204794 | | 8/1990 |
| JP | 9-327099 | | 12/1997 |
| JP | 2000-091865 | | 3/2000 |
| JP | 2001-339799 | | 12/2001 |
| JP | 2002-135900 | | 5/2002 |
| JP | 2003-91290 | | 3/2003 |
| JP | 2003-150157 | | 5/2003 |
| JP | 2003-202861 | | 7/2003 |
| WO | WO 99/41880 | | 8/1999 |
| WO | WO 00/48379 | | 8/2000 |

OTHER PUBLICATIONS

Stephen T. Neely, et al.,"Invertibility of a room impulse response", Journal of the Acoustical Societ of America, vol. 66, No. 1, XP008021714, Jul. 1979, pp. 165-169.

Antonio Fischetti, "Caractéristiques d'une salle", Initiation à l'acoustique, Cours et Exercices, 2003, pp. 79-80, (plus two cover pages).

* cited by examiner

| Parameter | Norm (definition) | Typical value |
|---|---|---|
| late reverbrance | Time length of reverberation | 1.4~2.8 (sec) |
| live ness | Time length of reverberation of high pitch sounds | 1.5~2.2 (sec) |
| source presence | Ratio of direct sound to initial reflected sound | -2~2 (db) |
| warmth | Ratio of initial reflected sound of low pitch sounds to that of high pitch sounds | 1.2~1.25 (db) |
| room presence | Level of reverberant sound | -0.5~0.5 (db) |
| running reverberance | Time length of reverberation of initial reflected sound | 1.8~2.6 (sec) |
| envelopment | Ratio of the direct sound to initial reflected sound | 0.1~0.3 (%) |

FIG.2A

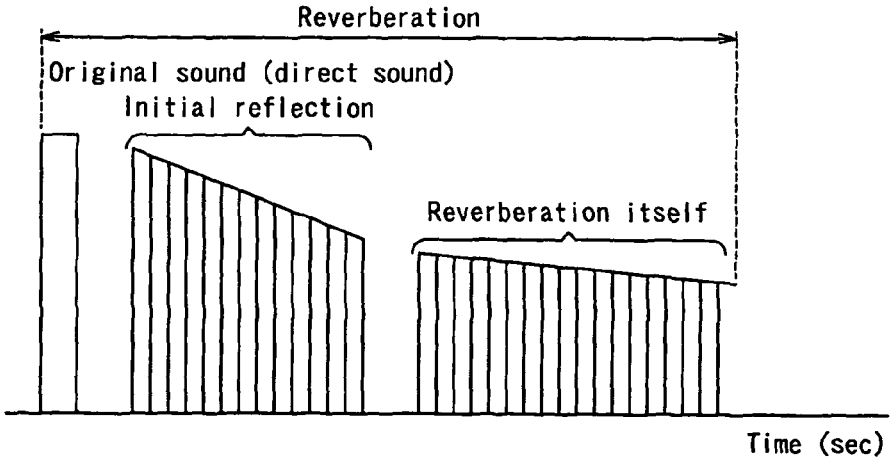

FIG.2B

REPRODUCTION APPARATUS AND REPRODUCTION SYSTEM

CROSS REFERENCE TO RELATED APPLICATIONS

The present invention contains subject matter related to Japanese Patent Application JP 2004-248951 filed in Japanese Patent Office on Aug. 27, 2004, the entire contents of which being incorporated herein by reference.

BACKGROUND OF THE INVENTION

1. Field of the Invention

This invention relates to a reproduction apparatus that can suitably be used for reproducing music from a music source that is obtained by recording in a concert hall or the like in a music listening room and also to a reproduction system configured by using a plurality of such reproduction apparatus.

2. Description of the Related Art

The acoustic characteristics of music listening rooms differ from room to room in terms of size, profile and internal decoration of the music listening room. Therefore, acoustic reproduction apparatus are marketed for the purpose of adjusting the acoustic characteristics of a music listening room to standardized ones or to those that match the taste of the listener.

For instance, such an acoustic reproduction apparatus is so designed as to irradiate a measuring signal for measuring the acoustic characteristics in the music listening room, collect responses (reflected sounds) and computationally determines the internal acoustic characteristics of the music listening room. Then, the apparatus computationally determines the correcting characteristics for correcting the acoustic characteristics in the music listening room and corrects the reproduced signals by means of the computationally determined correcting characteristics (Patent Document 1: Japanese Patent Application Laid-Open Publication No. 6-327089).

It is necessary to determine the transfer function from the position of the sound source to the listening position when measuring the internal acoustic characteristics of a music listening room. In the case of a music listening room, the position of the sound source is each of those of the speakers of the acoustic reproduction apparatus.

For example, the two speakers arranged at left and right front positions define respective sound source positions in an intensity stereo system. A 5.1 channel system comprises two speakers arranged respectively at left and right front positions, a speaker arranged at a central front position, two speakers arranged respectively at left and right rear positions and a woofer and these six speakers define respective sound source positions in the system. Thus, when speakers define respective sound source positions, the acoustic characteristics are measured for the speaker of each channel. Then, the transfer function of all the channels that are driven to operate is determined by computationally determining the sum of the transfer functions of all the channels.

The measuring microphone that is arranged at the listening position is either one that shows directional characteristics similar to those of the listener or a proximity 4 point microphone that can search for the positions of sound sources (Non-Patent Document 1: Yoshio Yamazaki, Tsuyoshi Ito, "Acoustic Measurement of a Concert Hall by a Proximity 4 Point Method", JAS Journal, October, 1987).

Measuring microphones showing directional characteristics similar to those of the listener include dummy head microphones and simplified versions thereof include those buried in the surface of a spheroid prepared by simulating the human head at opposite lateral sides thereof Methods of acquiring information on installation of audio systems and adjustment of acoustic characteristics of the audio system by way of a network and causing the audio system to automatically adjust the characteristics thereof have also been proposed.

With such a method, a center server is provided and a service system is built so as to comprise the center server and audio systems connected to the center server by way of a communication network. Then, the center server transmits data for adjusting audio equipment and data for installing audio equipment to each of the audio systems.

On the other hand, each of the audio systems is automatically adjusted for its characteristics by using the data for adjusting the audio equipment it has received. Additionally, the audio system displays the data for installing audio equipment it has received so that the user may install the audio equipment in a car by referring to the displayed method of installing the audio equipment (Patent Document 2: Japanese Patent Application Laid-Open Publication No. 2002-67815).

Non-Patent Document 2: Mikio Tohyama et al., "The Correlation Coefficient between the Two Ears in a Diffused and Reproduced Acoustic Space", The Acoustic Society of Japan, Technical Committee of Psychological and Physiological Acoustics Group Data Book, H-84-28, 1984 is known.

SUMMARY OF THE INVENTION

Meanwhile, it is known that, when a music work is played by a plurality of instrument players in an orchestra or the like, the performances of the players mutually influence so as to exploit the potentials of the players and make the overall performance more refined than the performance of each of the players.

When the players are located at respective remote sites, it may be possible to transmit and receive the performance of each of the players by way of a network. However, it is difficult to make the players feel as if they were playing in a same limited space.

In view of the above identified circumstances, it is therefore desirable to provide a reproduction apparatus and a reproduction system for making the players located at respective remote sites feel as if they were playing live in a same limited space.

According to the present invention, there is provided a reproduction apparatus comprising: an inverse characteristics conversion means for converting the acoustic characteristics of an acoustic space into inverse characteristics thereof; a reproduction means for reproducing music data; an acoustic characteristics output means for outputting acoustic characteristics different from the acoustic characteristics of the acoustic space; an adjustment means for adjusting the music data reproduced by the reproduction means on the basis of the inverse acoustic characteristics of the acoustic space converted by the inverse characteristics conversion means and the acoustic characteristics output from the acoustic characteristics output means; and an output means for outputting the music data adjusted by the adjustment means to the acoustic space.

Preferably, in a reproduction apparatus according to the invention, the adjustment means is adapted to add pseudo reflected sounds and/or pseudo reverberated sounds conforming to the acoustic characteristics output by the acoustic characteristics output means to the music data reproduced by the reproduction means.

Preferably, a reproduction apparatus according to the invention further comprises: a measurement signal generation means for generating a predetermined measurement signal; a microphone for detecting the signal output to the acoustic space, the signal being generated by the measurement signal generation means and output to the acoustic space by way of the output means; and an acoustic characteristics generation means for generating acoustic characteristics of the acoustic space on the basis of the signal detected by the microphone and the signal generated by the measurement signal generation means; the inverse characteristics conversion means being adapted to convert the acoustic characteristics generated by the acoustic characteristics generation means into inverse characteristics.

Preferably, a reproduction apparatus according to the invention further comprises: a microphone for detecting the music data output to the acoustic space, the music data being reproduced by the reproduction means and output to the acoustic space by the way of the output means; and an acoustic characteristics generation means for generating acoustic characteristics of the acoustic space on the basis of the music data detected by the microphone and the music data reproduced by the reproduction means; the inverse characteristics conversion means being adapted to convert the acoustic characteristics generated by the acoustic generation means into inverse characteristics.

Preferably, a reproduction apparatus according to the invention further comprises: a database storing a plurality of sets of acoustic characteristics different from that of the acoustic space; and a read means for reading out a set of acoustic characteristics on the basis of the music data reproduced by the reproduction means; the adjustment means being adapted to adjust the music data reproduced by the reproduction means on the basis of the inverse acoustic characteristics of the acoustic space obtained by conversion by the inverse characteristics conversion means and the set of acoustic characteristics read out by the read means.

Preferably, in a reproduction apparatus according to the invention, the database is connected to the reproduction apparatus by way of a network.

According to the present invention, there is provided a reproduction system comprising a first reproduction apparatus arranged in an acoustic space and a second reproduction apparatus arranged in another acoustic space and connected to the first reproduction apparatus by way of a network, the first reproduction apparatus including: a first inverse characteristics conversion means for converting the acoustic characteristics of an acoustic space into inverse characteristics thereof; a first reproduction means for reproducing the music data supplied from the second reproduction apparatus by way of the network; a first acoustic characteristics output means for outputting acoustic characteristics different from the acoustic characteristics of the acoustic space; a first adjustment means for adjusting the music data reproduced by the first reproduction means on the basis of the inverse acoustic characteristics of the acoustic space converted by the first inverse characteristics conversion means and the acoustic characteristics output from the first acoustic characteristics output means; and a first output means for outputting the music data adjusted by the first adjustment means to the acoustic space; a first sound collecting means for collecting the music data output from the first output means; and a first supply means for supplying the music data collected by the first sound collecting means to the second reproduction apparatus by way of the network, and the second reproduction apparatus including: a second inverse characteristics conversion means for converting the acoustic characteristics of another acoustic space into inverse characteristics thereof, a second reproduction means for reproducing the music data supplied from the first reproduction apparatus by way of the network; a second acoustic characteristics output means for outputting acoustic characteristics different from the acoustic characteristics of the other acoustic space; a second adjustment means for adjusting the music data reproduced by the second reproduction means on the basis of the inverse acoustic characteristics of the other acoustic space converted by the second inverse characteristics conversion means and the acoustic characteristics output from the second acoustic characteristics output means; and a second output means for outputting the music data adjusted by the second adjustment means to the other acoustic space; a second sound collecting means for collecting the music data output from the second output means; and a second supply means for supplying the music data collected by the second sound collecting means to the first reproduction apparatus by way of the network.

Preferably, in a reproduction system according to the invention, the first adjustment means is adapted to add pseudo reflected sounds and/or pseudo reverberated sounds conforming to the acoustic characteristics output by the first acoustic characteristics output means to the music data reproduced by the first reproduction means; and the second adjustment means is adapted to add pseudo reflected sounds and/or pseudo reverberated sounds conforming to the acoustic characteristics output by the second acoustic characteristics output means to the music data reproduced by the first reproduction means.

Preferably, in a reproduction system according to the invention, the first reproduction apparatus further includes: a first measurement signal generation means for generating a predetermined measurement signal; a first microphone for detecting the signal output to the acoustic space, the signal being generated by the first measurement signal generation means and output to the acoustic space by way of the first output means; and a first acoustic characteristics generation means for generating acoustic characteristics of the acoustic space on the basis of the signal detected by the first microphone and the signal generated by the first measurement signal generation means; the first inverse characteristics conversion means being adapted to convert the acoustic characteristics generated by the first acoustic characteristics generation means into inverse characteristics, and the second reproduction apparatus further includes: a second measurement signal generation means for generating a predetermined measurement signal; a second microphone for detecting the signal output to the other acoustic space, the signal being generated by the second measurement signal generation means and output to the other acoustic space by way of the second output means; and a second acoustic characteristics generation means for generating acoustic characteristics of the other acoustic space on the basis of the signal detected by the second microphone and the signal generated by the second measurement signal generation means; the second inverse characteristics conversion means being adapted to convert the acoustic characteristics generated by the second acoustic characteristics generation means into inverse characteristics.

Preferably, in a reproduction system according to the invention, the first reproduction apparatus further includes: a first microphone for detecting the music data output to the acoustic space, the music data being reproduced by the first reproduction means and output to the acoustic space by the way of the first output means; a first acoustic characteristics generation means for generating acoustic characteristics of the acoustic space on the basis of the music data detected by the first microphone and the music data reproduced by the first reproduction means; the first inverse characteristics conversion means being adapted to convert the acoustic characteristics generated by the first acoustic characteristics generation means into inverse characteristics, and the second reproduction apparatus further includes: a second microphone for detecting the music data output to the other acoustic space, the music data being reproduced by the second reproduction means and output to the other acoustic space by the way of the second output means; a second acoustic characteristics generation means for generating acoustic characteristics of the other acoustic space on the basis of the music data detected by the second microphone and the music data reproduced by the second reproduction means; the second inverse characteristics conversion means being adapted to convert the acoustic characteristics generated by the second acoustic characteristics generation means into inverse characteristics.

Preferably, in a reproduction system according to the invention, the first reproduction apparatus further includes: a first database storing a plurality of sets of acoustic characteristics different from that of the acoustic space; and a first read means for reading out a set of acoustic characteristics from the first database on the basis of the music data reproduced by the first reproduction means; the first adjustment means being adapted to adjust the music data reproduced by the first reproduction means on the basis of the inverse acoustic characteristics of the acoustic space obtained by conversion by the first inverse characteristics conversion means and the set of acoustic characteristics read out by the first read means, and the second reproduction apparatus further includes: a second database storing a plurality of sets of acoustic characteristics different from that of the other acoustic space; and a second read means for reading out a set of acoustic characteristics from the second database on the basis of the music data reproduced by the second reproduction means; the second adjustment means being adapted to adjust the music data reproduced by the second reproduction means on the basis of the inverse acoustic characteristics of the other acoustic space obtained by conversion by the second inverse characteristics conversion means and the set of acoustic characteristics read out by the second read means.

Preferably, in a reproduction system according to the invention, the first database and the second database are connected respectively to the first and second reproduction apparatus by way of a network.

Thus, according to the invention, the acoustic characteristics and the acoustic space characteristics of the studio (acoustic space for sound reproduction) and the acoustic characteristics and the acoustic space characteristics of the other studio (acoustic space for sound reproduction) can be exchanged with each other, it is possible to produce acoustic effects that make the performers of the two different acoustic spaces feel as if they were playing live together in a same acoustic space.

BRIEF DESCRIPTION OF THE DRAWINGS

FIG. 2A is a table of parameters showing the properties of an acoustic space for sound reproduction, the parameters being recorded as meta-data in a recording medium, and FIG. 2B is a graph illustrating the reverberation of an acoustic space for sound reproduction;

DETAILED DESCRIPTION OF THE PREFERRED EMBODIMENTS

Now, the present invention will be described in greater detail by referring to the accompanying drawings that illustrate preferred embodiments of the invention.

Figure 1:
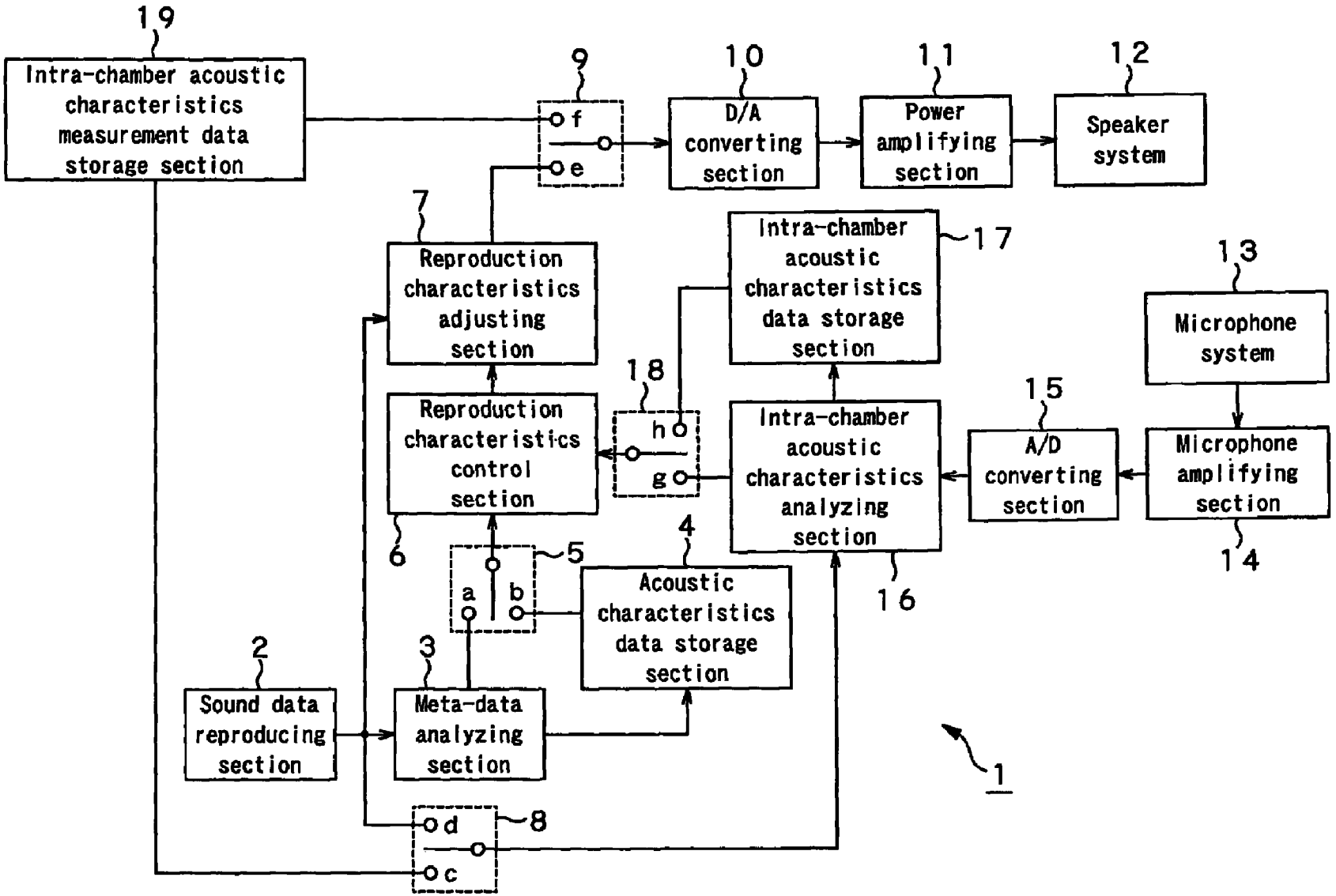
FIG. 1 is a schematic block diagram of an embodiment of reproduction apparatus according to the invention.

FIG. 1 is a schematic block diagram of an embodiment of acoustic reproduction apparatus 1 according to the invention. Referring to FIG. 1, the acoustic reproduction apparatus 1 comprises a sound data reproducing section 2 for reproducing sound data, a meta-data analyzing section 3 for extracting space characteristics data (meta-data) from sound data, an acoustic characteristics data storage section 4 for storing meta-data, a changeover switch 5 for selecting either the meta-data analyzed by the meta-data analyzing section 3 or the meta-data stored in the acoustic characteristics data storage section 4, a reproduction characteristics control section 6 for controlling the reproduction signal supplied to reproduction characteristics adjusting section 7 on the basis of the meta-data and the intra-chamber acoustic characteristics, the reproduction characteristics adjusting section 7 for adjusting the reproduction signal under the control of the reproduction characteristics control section 6, a changeover switch 8 for selecting either the sound data supplied form the sound data reproducing section 2 or the signal supplied from intra-chamber acoustic characteristics measurement data storage section 19, a changeover switch 9 for selecting either the sound data output from the reproduction characteristics adjusting section 7 or the acoustic characteristics measurement data output from the intra-chamber acoustic characteristics measurement data storage section 19, a D/A converting section 10 for converting the data supplied by way of the changeover switch 9 into an analog signal, a power amplifying section 11 for amplifying the analog signal produced by the conversion by the D/A converting section 10, a speaker system 12 for outputting the amplified signal, a microphone system 13 for collecting acoustic data, a microphone amplifying section 14 for amplifying the collected acoustic data, an A/D converting section 15 for converting the amplified acoustic data into a digital signal, an intra-chamber acoustic characteristics analyzing section 16 for analyzing the acoustic characteristics of the environment collected by the microphone system 13, an intra-chamber acoustic characteristics data storage section 17 for storing the acoustic characteristics analyzed by the intra-chamber acoustic characteristics analyzing section 16, a changeover switch 18 for selecting either the data analyzed by the intra-chamber acoustic characteristics analyzing section 16 or the data stored in the intra-chamber acoustic characteristics data storage section 17 and the intra-chamber acoustic characteristics measurement data storage section 19 for storing measurement data for measuring intra-chamber acoustic characteristics. Note that it is assumed in the following description that the acoustic reproduction apparatus 1 is arranged in a predetermined studio (acoustic space for sound reproduction: hereinafter referred to as studio).

The sound data reproducing section 2 reproduces the sound data recorded on an on-mike basis so as to eliminate reflected sounds and reverberated sounds and also replays a recording medium, which may typically be an optical disc, on which the meta-data indicating the properties of the space where the sound data are reproduced are recorded. The sound data reproducing section 2 supplies the reproduced sound data to the reproduction characteristics adjusting section 7 and the changeover switch 8. Additionally, the sound data reproducing section 2 also supplies the meta-data reproduced from the recording medium to the meta-data analyzing section 3.

Note, however, the sound data reproducing section 2 may be so adapted to reproduce the sound data and the meta-data supplied from some other reproduction apparatus arranged at a remote site by way of a network.

The meta-data analyzing section 3 is adapted to acquire the meta-data input to it by way of the sound data reproducing section 2. Then, it determines the acoustic characteristics of a studio, which is an acoustic space for sound reproduction, suitable for reproducing the sound data by analyzing the meta-data it has acquired. The properties of an acoustic space for sound reproduction that are recorded on a recording medium as meta-data may be illustrated in a manner as shown in FIGS. 2A and 2B.

The properties of an acoustic space for sound reproduction are indicated by reverberation. As shown in FIG. 2B, reverberation includes an original sound (direct sound), an initial reflected sound and a reverberated sound of the reverberation itself Thus, the parameters and their norms (definitions) as listed in FIG. 2A may be used to indicate the properties of an acoustic space for sound reproduction.

Referring to FIG. 2A, late reverbrance is defined as the time length of reverberation from the direct sound to the reverberation itself, which is typically between 1.4 and 2.8 (sec). Liveness is defined as the time length of reverberation of high pitch sounds, which is typically between 1.5 and 2.2 (sec). Source presence is defined as the ratio of the direct sound to the initial reflected sound, which is typically between −2 to 2 (dB). Warmth is defined as the ratio of the initial reflected sound of low pitch sounds to that of high pitch sounds, which is typically between 1.2 and 1.25 (dB). Room presence is defined as the intensity of reverberant sound, which is typically between −0.5 and 0.5 (dB). Running reverbrance is defined as the time length of reverberation of the initial reflected sound, which is typically between 1.8 and 2.6 (sec). Envelopment is defined as the ratio of the direct sound to the initial reflected sound, which is typically between 0.1 and 0.3 (%).

The acoustic characteristics data storage section 4 is typically realized by a memory device and stores the acoustic characteristics data analyzed by the meta-data analyzing section 3.

The changeover switch 5 has terminal a and terminal b. The terminal a is connected to the meta-data analyzing section 3, whereas the terminal b is connected to the acoustic characteristics data storage section 4. It is a switch for supplying either the acoustic characteristics data of the meta-data analyzing section 3 or the acoustic characteristics data of the acoustic characteristics data storage section 4 to the reproduction characteristics control section 6.

The reproduction characteristics control section 6 controls the reproduction characteristic adjusting section 7 on the basis of the acoustic characteristics data input to it from the meta-data analyzing section 3 or the acoustic characteristics data storage section 4 by way of the changeover switch 5 and the intra-chamber acoustic characteristics data input to it by way of the changeover switch 18. The method of acquiring acoustic characteristics data of a studio will be discussed hereinafter.

The reproduction characteristics adjusting section 7 adjusts the acoustic characteristics of the sound data reproduced by the sound data reproduction section 2 under the control of the reproduction characteristics control section 6.

The changeover switch 8 has terminal c and terminal d. The terminal c is connected to the intra-chamber acoustic characteristics measurement data storage section 19, whereas the terminal d is connected to the sound data reproducing section 2. It is a switch for supplying either the measurement data of the intra-chamber acoustic characteristics measurement data storage section 19 or the sound data of the sound data reproducing section 2 to the intra-chamber acoustic characteristics analyzing section 16.

The changeover switch 9 has terminal e and terminal f. The terminal e is connected to the reproduction characteristics adjusting section 7, whereas the terminal f is connected to the intra-chamber acoustic characteristics measurement data storage section 19. It is a switch for supplying either the sound data from the reproduction characteristics adjusting section 7 or the acoustic characteristics measurement data from the acoustic characteristics measurement data storage section 19, which will be described in greater detail hereinafter, to the downstream D/A converting section 10.

The D/A converting section 10 converts the digital signal (sound data or acoustic characteristics measurement data) input to it by way of the changeover switch 9 into an analog signal (sound signal or acoustic characteristics measurement signal) and outputs it.

The power amplifying section 11 amplifies the analog signal supplied from the D/A converting section 10 to a predetermined level and supplies the amplified signal to the speaker system 12.

The speaker system 12 outputs the signal amplified by the power amplifying section 11 as audible sound.

The microphone system 13 is arranged at a predetermined listening point (listening position) for measuring the intra-chamber acoustic characteristics of the studio and collect sounds (acoustic data) at the position.

The microphone amplifying section 14 amplifies the collected acoustic data signal obtained as a result of the sound collecting operation of the microphone system 13 and outputs the signal.

The A/D converting section 15 converts the analog collected acoustic data signal from the microphone amplifying section 14 into a digital collected acoustic data signal and outputs the signal.

The intra-chamber acoustic characteristics analyzing section 16 analyzes the collected acoustic data that are input to it by way of the A/D converting section 15, using the input signal input to it by way of the changeover switch 8 as reference signal, and acquires the intra-chamber acoustic characteristics of the studio.

The intra-chamber acoustic characteristics data storage section 17 is typically realized by a memory device and stores the intra-chamber acoustic characteristics data acquired by the intra-chamber acoustic characteristics analyzing section 16.

The changeover switch 18 has terminal g and terminal h. The terminal g is connected to the intra-chamber acoustic characteristics analyzing section 16, whereas the terminal h is connected to the intra-chamber acoustic characteristics data storage section 17. It is a switch for supplying either the acoustic characteristics data temporarily stored in the intra-chamber acoustic characteristics data storage section 17 or the acoustic characteristics data directly output from the intra-chamber acoustic characteristics analyzing section 16 to the reproduction characteristics control section 6 as acoustic characteristics data.

The intra-chamber acoustic characteristics measurement data storage section 19 stores measurement data for measuring intra-chamber acoustic characteristics of a studio or the like. Such measurement data may be an M-sequence (maximum length sequence) signal or a TSP (time stretched pulse) signal.

The acoustic reproduction apparatus 1 further comprises a system controller (not shown) that controls the overall operation of the apparatus 1 and the switching operations of the changeover switches 5, 8, 9 and 18 as well as other related operations.

The acoustic reproduction apparatus 1 having the above described configuration is designed to adjust the acoustic characteristics of the sound data to be output to the studio on the basis of the acoustic characteristics obtained from the meta-data recorded on a recording medium or the meta-data supplied to it by way of a network and the intra-chamber acoustic characteristics of an actual studio. For this reason, the acoustic reproduction apparatus 1 is equipped with a meta-data analyzing section 3 for acquiring the acoustic characteristics of sound data and a microphone system 13 for measuring the intra-chamber acoustic characteristics of the studio.

Figure 3A:
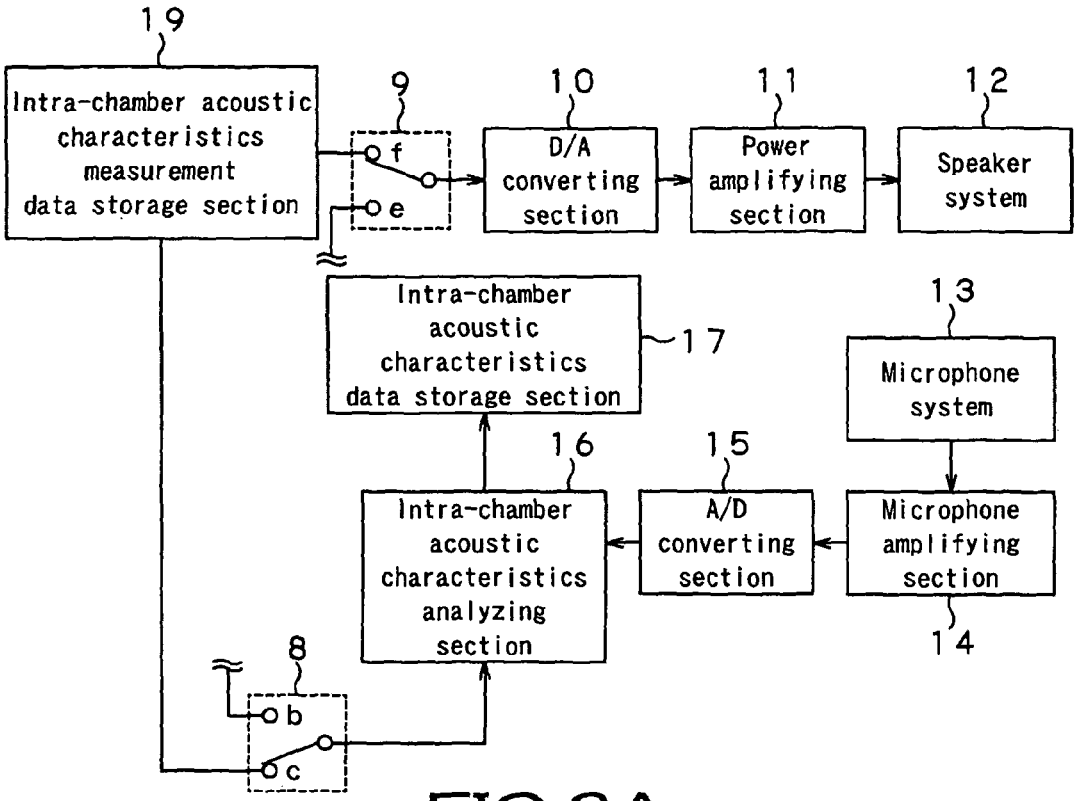
FIGS. 3A and 3B are schematic block diagrams of principal parts of the embodiment of reproduction apparatus of FIG. 1 that are adapted to measure the acoustic characteristics.
Figure 3B:
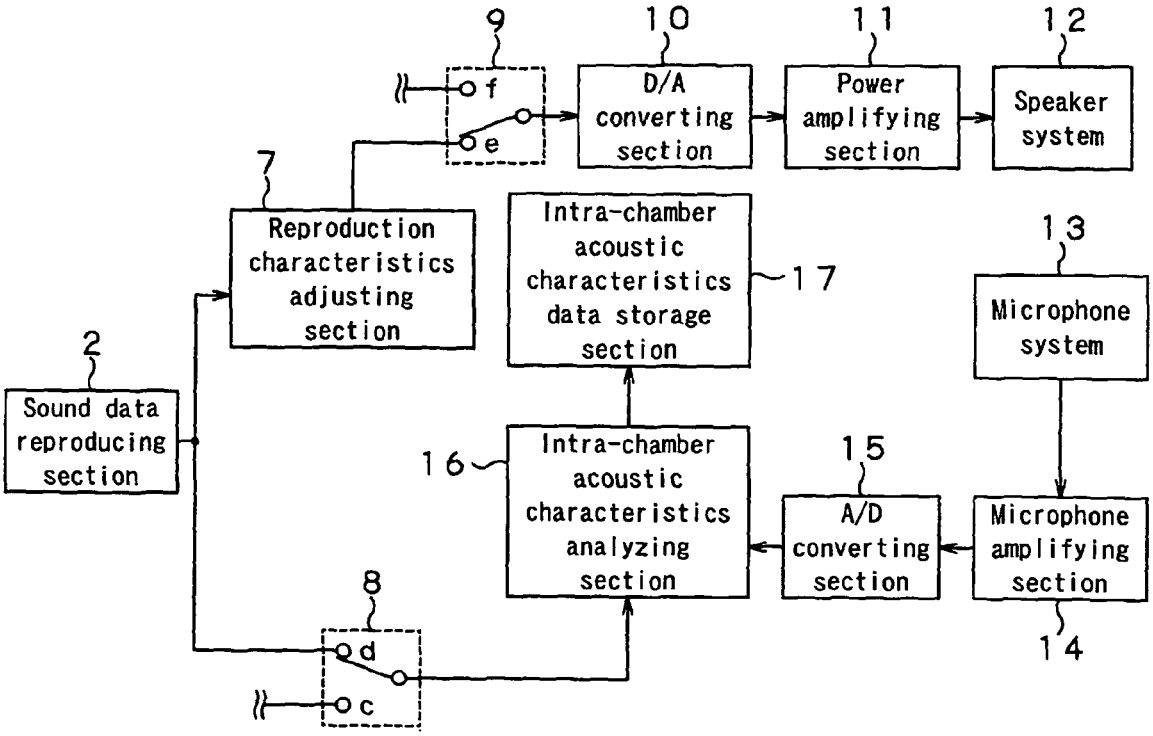

FIGS. 3A and 3B are schematic block diagrams of principal parts of the acoustic reproduction apparatus 1 that are adapted to measure acoustic characteristics. FIG. 3A is a schematic block diagram of a principal part of the acoustic reproduction apparatus 1 adapted to measure acoustic characteristics by utilizing the intra-chamber acoustic characteristics measurement data storage section 19. When this part is used, the sound source data that suit the measurement items are selectively read out from the intra-chamber acoustic characteristics measurement data storage section 19. Then, the acoustic reproduction apparatus 1 transmits the read out measurement data to the D/A converting section 10 by way of the changeover switch 9 and, after the D/A conversion in the D/A converting section 10, the measurement data are amplified by the power amplifying section 11 and the amplified corresponding measurement signal is output from the speaker system 12.

The output sounds of the speaker system 12 are collected by the microphone of the microphone system 13 arranged at a predetermined measurement listening point in the studio.

The signal representing the collected sounds, or the collected sound signal, that is output from the microphone of the microphone system 13 is amplified by the microphone amplifying section 14 and the amplified collected sound signal is subjected to A/D conversion in the A/D converting section 15 before it is transmitted to the intra-chamber acoustic characteristics analyzing section 16.

The intra-chamber acoustic characteristics analyzing section 16 obtains the acoustic characteristics (the transfer function) of the studio by analyzing the acoustic data of the collected sounds, using the measurement data input from the intra-chamber acoustic characteristics measurement data storage section 19 by way of the changeover switch 8 as reference data. The outcome of the analysis of the intra-chamber acoustic characteristics analyzing section 16 is stored in the intra-chamber acoustic characteristics data storage section 17.

The intra-chamber acoustic characteristics analyzing section 16 obtains the transfer function of the studio, using the measurement data from the intra-chamber acoustic characteristics measurement data storage section 19 as reference data for the reason as described below.

Basically, the transfer function of a studio can be obtained as collected sound signal acquired by the microphone system 13 when an impulse signal is output from the speaker system 12 as signal representing the sound to be measured and the response of the studio is collected by the microphone system 13. However, with this technique, it is difficult to raise the S/N (signal-to-noise) ratio. Therefore, in this embodiment, a signal showing a high energy level is used as measurement data and the intra-chamber acoustic characteristics analyzing section 16 computationally determines the transfer function of the studio by dividing the acoustic data (response signal) collected and input by way of the A/D converting section 15 by the measurement data input by way of the changeover switch 8.

According to the Non-Patent Document 2, it is possible to judge if an acoustic space shows a natural diffusibility or not by analyzing the correlation coefficient of each of the two non-directional microphones arranged with an equivalent interaural distance (about 30 cm) separating them. Therefore, it is possible to acquire intra-chamber acoustic characteristics data on conditions close to those of a natural diffusive acoustic space by varying the reproduction characteristics in several different ways and measuring the correlation coefficient at the listening position for each of the selected sets of reproduction characteristics.

It may alternatively be so arranged that the measurement data for intra-chamber acoustic characteristics that are generated from the intra-chamber acoustic characteristics measurement data storage section 19 in this embodiment may be generated by a processor such as a DSP (digital signal processor) each time such data are required.

On the other hand, FIG. 3B is a schematic block diagram of a principal part of the acoustic reproduction apparatus 1 adapted to measure acoustic characteristics without utilizing the intra-chamber acoustic characteristics measurement data storage section 19.

When the intra-chamber acoustic characteristics measurement data storage section 19 is not utilized, the sound data reproduced by the sound data reproducing section 2 are used as measurement data. More specifically, the sound data reproduced by the sound data reproducing section 2 are transmitted to the D/A converting section 10 by way of the reproduction characteristics adjusting section 7 and the changeover switch 9 and subjected to D/A conversion in the D/A converting section 10 before they are amplified by the power amplifying section 11 and then the amplified sound signal is output from the speaker system 12.

In this case again, the output sounds of the speaker system 12 are collected by the microphone of the microphone system 13. The collected sound signal output from the microphone of the microphone system 13 is amplified by the microphone amplifying section 14 and the amplified collected sound signal is subjected to A/D conversion in the A/D converting section 15 before it is transmitted to the intra-chamber acoustic characteristics analyzing section 16.

The intra-chamber acoustic characteristics analyzing section 16 acquires the acoustic characteristics (transfer function) of the studio, which is an acoustic space for sound reproduction, by analyzing the amplified collected sound signal according to the measurement items, utilizing the sound data input to it from the sound data reproducing section 2 by way of the changeover switch 8.

The outcome of the analysis of the intra-chamber acoustic characteristics analyzing section 16 is stored in the intra-chamber acoustic characteristics data storage section 17. In this case again, the transfer function of the studio is obtained by dividing the collected acoustic data (response signal) by the sound data (input signal). It is also possible to store the intra-chamber acoustic characteristics of each of a number of representative studios in the intra-chamber acoustic characteristics data storage section 17.

Thus, the acoustic reproduction apparatus 1 of this embodiment having the above described configuration measures the intra-chamber acoustic characteristics of the studio and adjusts the acoustic characteristics of the sound data reproduced by the sound data reproducing section 2 in the reproduction characteristics adjusting section 7 on the basis of the acoustic characteristics of the studio obtained by measurement and the acoustic characteristics of the meta-data recorded in the recording medium.

With this arrangement, the acoustic reproduction apparatus 1 of this embodiment can adjust the acoustic characteristics of the sound signal to be reproduced according to the intra-chamber acoustic characteristics of the studio and the acoustic characteristics of the sound signal of the music source to be reproduced that were observed when the sound signal is recorded.

Thus, as a result, it is possible to automatically adjust the acoustic characteristics of the sound signal to be reproduced without requiring the user to adjust the acoustic characteristics even when music sources that are different from each other in terms of genre and recording environment are reproduced by the acoustic reproduction apparatus 1.

Figure 4:
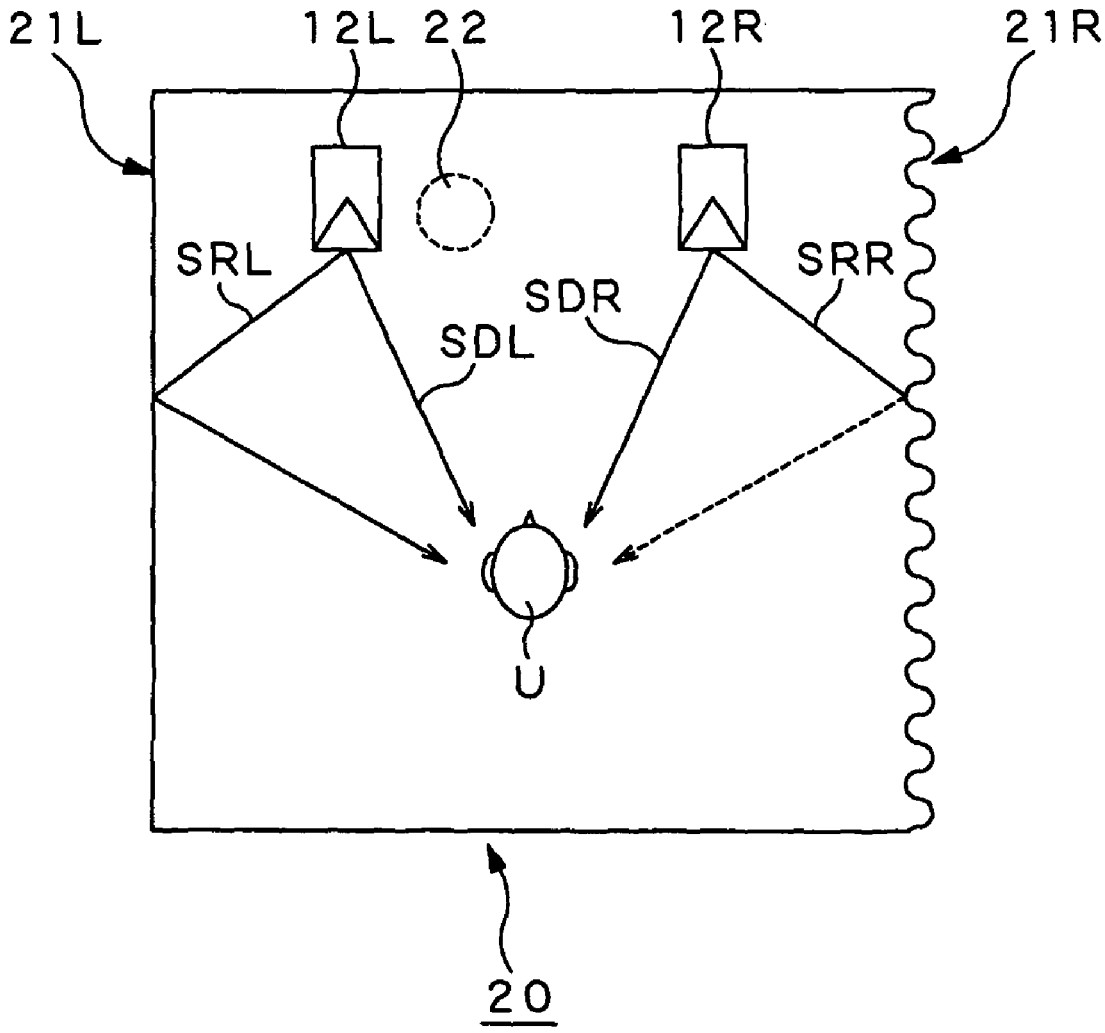
FIG. 4 is a schematic illustration of a studio.

Now, the acoustic characteristics that are influenced by the studio for the sound image will be described below. An asymmetric structure of a studio can influence the acoustic characteristics. FIG. 4 schematically illustrates such a studio.

In the studio 20 illustrated in FIG. 4, the right wall surface 21R is more sound absorbing than the left wall surface 21L relative to the listener U and the right wall surface 21R substantially does not reflect any sound. In other words, the left wall surface 21L and the right wall surface 21R remarkably differ from each other in terms of sound reflection.

If the sound reaching the listener U from the left speaker 12L arranged at a front left position relative to the listener U and the sound reaching the listener U from the right speaker 12R arranged at a front right position relative to the listener U are compared with each other, the direct sounds SDL, SDR that reach the listener U directly and respectively from the speakers 12L, 12R are substantially of the same level but the reflected sounds SRL, SRR that are reflected by the left and right wall surfaces 21L, 21R remarkably differ from each other in terms of sound level. Then, as a result, the sound image of the studio 20 will be affected seriously. For example, the sound image 22 of a vocal sound source or a principal instrument that needs to be located at the middle of the left and right speakers 12L, 12R may be shifted to the side giving off a large reflected sound (left side in this instance) and/or only the resonance from a specific direction may become noticed.

Figure 5:
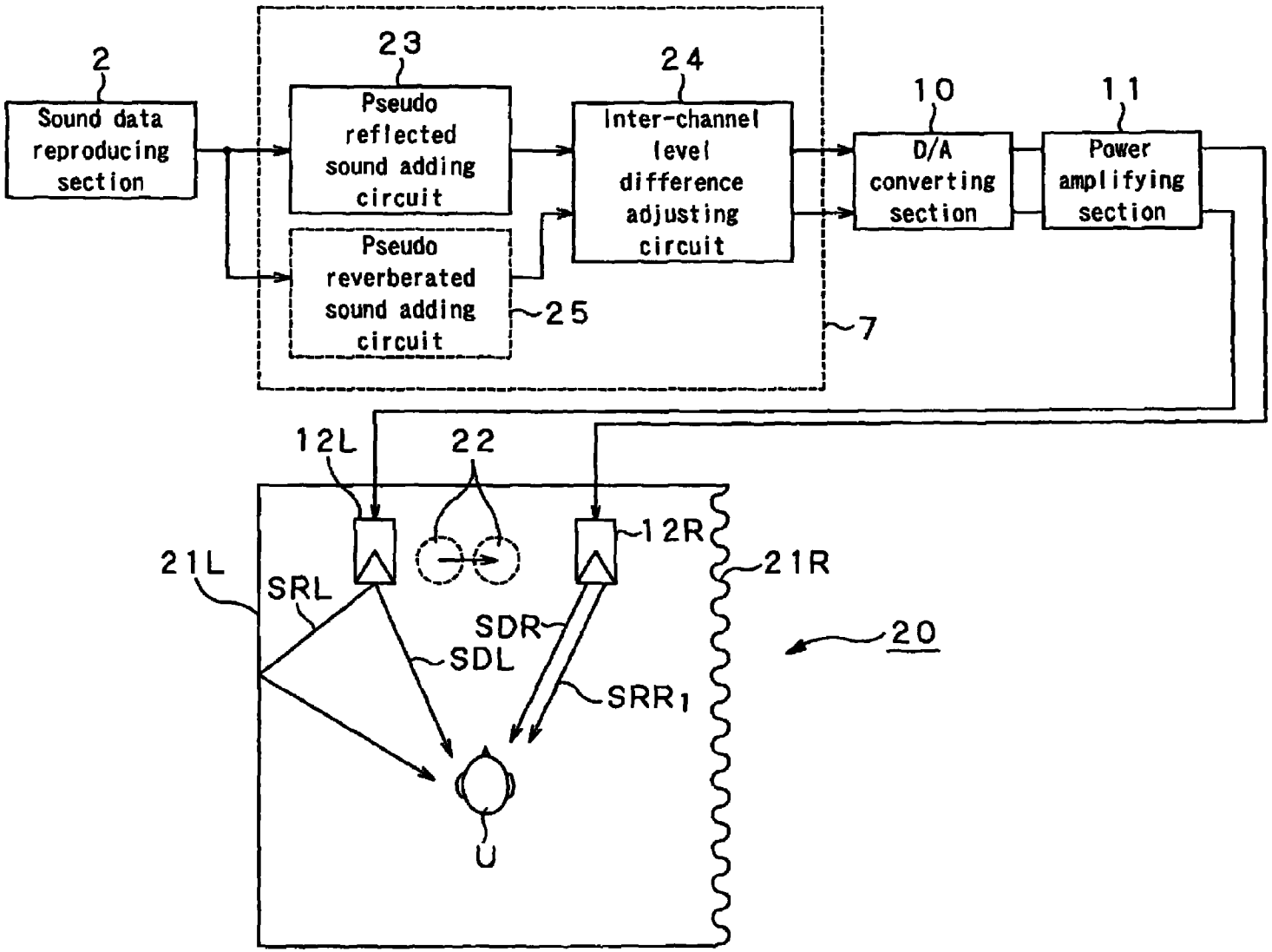
FIG. 5 is a schematic block diagram of the reproduction characteristics adjusting section of the embodiment of FIG. 1, showing the configuration thereof.

For this reason, the acoustic reproduction apparatus 1 of this embodiment is made to comprise a reproduction characteristics adjusting section 7 having a configuration as shown in FIG. 5 so as to adjust sound data.

Referring to FIG. 5, the reproduction characteristics adjusting section 7 comprises a pseudo reflected sound adding circuit 23 and an inter-channel level difference adjusting circuit 24. When the right wall surface 21R of the studio 20 practically does not give off any reflected sound, pseudo reflected sound data are added to the sound data output from the right speaker 12R by the pseudo reflected sound adding circuit 23. Then, the inter-channel level difference adjusting circuit 24 adjusts the level difference between the right and left channels and outputs the sound data.

With the above-described arrangement, when the right wall surface 21R of the studio 20 practically does not give off any reflected sound SRR, it is possible to place the sound image 22 of a vocal sound source substantially at the middle of the left and right speakers 12L, 12R due to the pseudo reflected sound SRR, from the right speaker 12R.

The reproduction characteristics adjusting section 7 may also include a pseudo reverberated sound adding circuit 25 as indicated by broken lines in FIG. 5 for the purpose of adding pseudo reverberated sound data to the reproduced sound from the right speaker 12R. Then, the sound image 22 of the vocal may be a more natural one as a result of the added pseudo reverberated sound.

Figure 6:
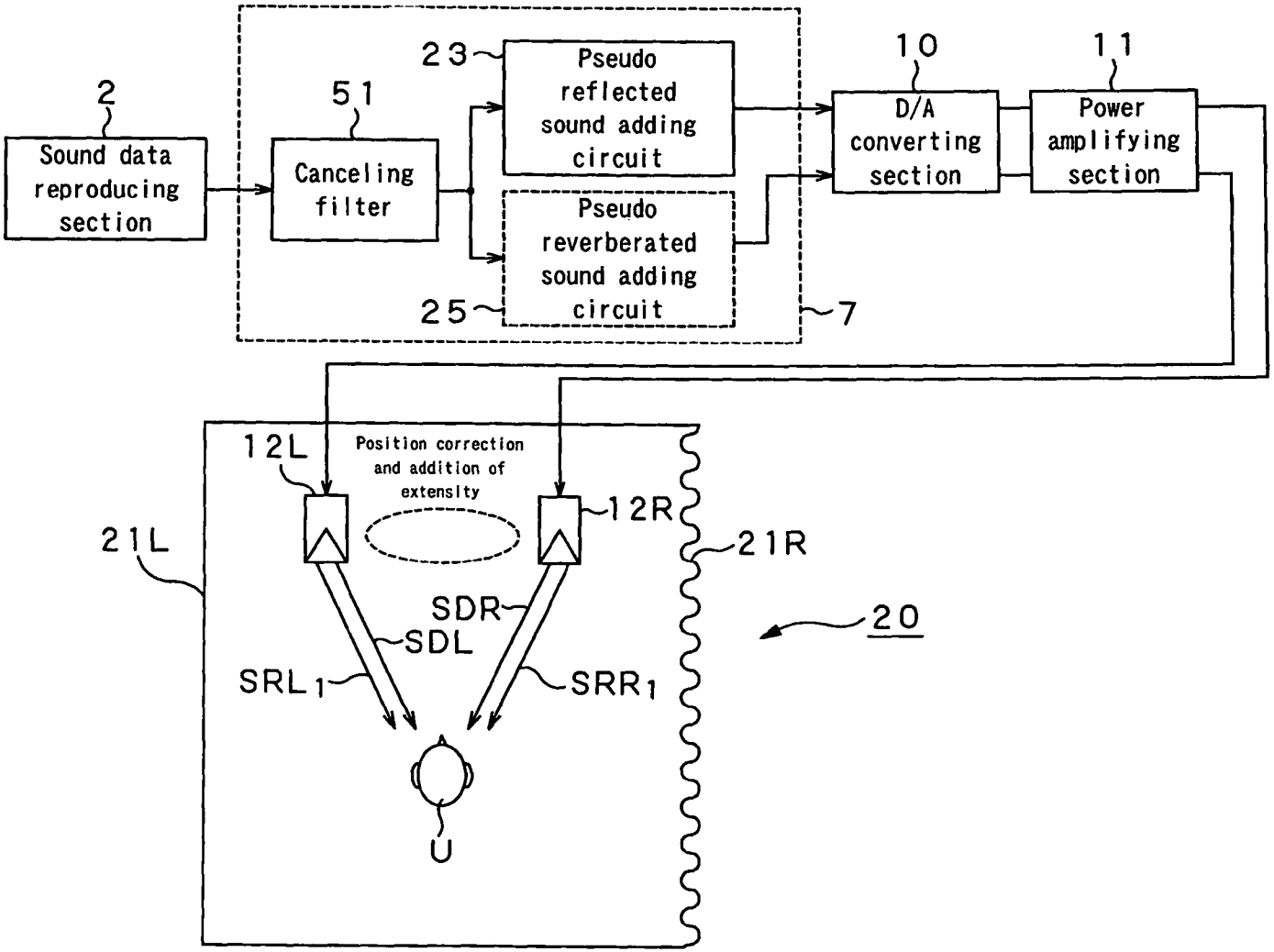
FIG. 6 is a schematic block diagram of the reproduction characteristics adjusting section of the embodiment of FIG. 1, showing an alternative configuration thereof.

Alternatively, the reproduction characteristics adjusting section 7 may have a configuration as shown in FIG. 6.

The reproduction characteristics adjusting section 7 of FIG. 6 comprises a canceling filter 51 and a pseudo reflected sound adding circuit 23. The canceling filter 51 is adapted to cancel the reproduced sound from the left and right speakers 12L, 12R in the studio 20 and then the pseudo reflected sound adding circuit 23 adds desired acoustic characteristics such as reflected sounds. In other words, the canceling filter 51 applies inverse characteristics so as to make the characteristics between the left and right speakers 12L, 12R and the listening position show flat frequency characteristics and then the pseudo reflected sound adding circuit 23 adds desired acoustic characteristics such as reflected sounds.

With the above-described arrangement, when the right wall surface 21R of the studio 20 practically does not give off any reflected sound SRR, it is possible to place a sound image 22 of a vocal sound source extending substantially at the middle of the left and right speakers 12L, 12R by means of a pseudo reflected sound $SRL_1$ from the left speaker 12L and a pseudo reflected sound SRR1 from the right speaker 12R.

The reproduction characteristics adjusting section 7 may also include a pseudo reverberated sound adding circuit 25 as indicated by broken lines in FIG. 6 for the purpose of adding pseudo reverberated sound data to the reproduced sound from the left and right speaker 12L and 12R. Then, the sound image 22 of the vocal may be a more natural one as a result of the added pseudo reverberated sound.

The canceling filter 51 will be described further by referring to FIG. 7. Note that, in FIG. 7, the head-diffracted transfer function of the route from the left speaker 67 to the left ear EL of the listener U is HLS and the head-diffracted transfer function of the route from the right speaker 68 to the right ear ER of the listener U is HRS in the acoustic space for sound reproduction 69. Similarly, in FIG. 7, the head-diffracted transfer function of the route from the left speaker 67 to the right ear ER of the listener U is HLO and the head-diffracted transfer function of the route from the right speaker 68 to the left ear EL of the listener U is HRO.

Figure 7:
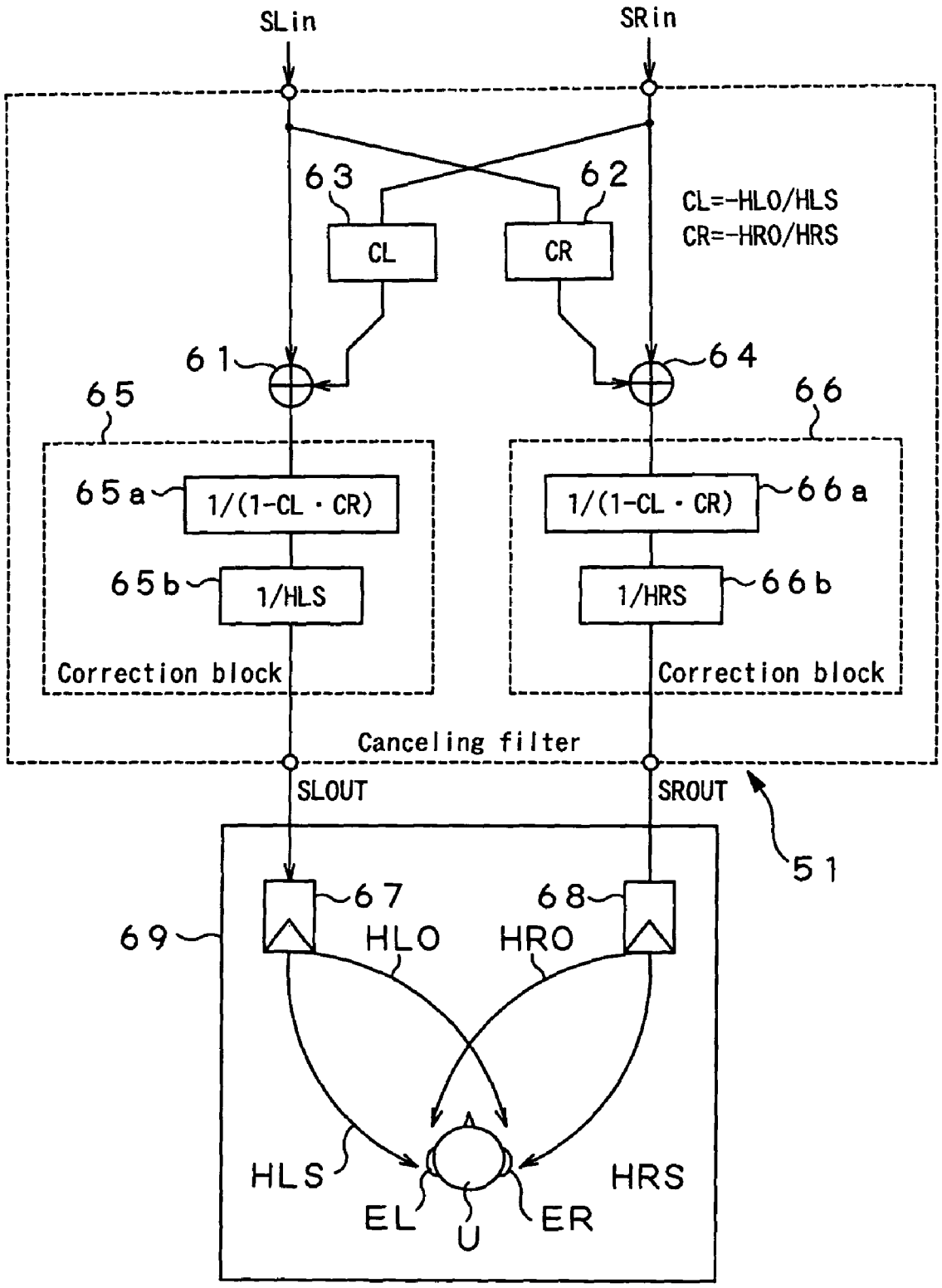
FIG. 7 is a schematic illustration of a canceling filter, showing the configuration thereof.

The canceling filter 51 shown in FIG. 7 receives the left collected sound signal SLin as left channel signal and the right collected sound signal SRin as right channel signal from a dummy headphone (not shown).

The left collected sound signal SLin, or the left channel signal, is input to adder 61 and cross talk canceling section 62. The right collected sound signal SRin, or the right channel signal, is input to adder 64 and cross talk canceling section 63.

The cross talk canceling sections 62, 63 are filters for canceling the cross talk component from the left speaker 67 to the right ear ER of the listener U and the cross talk component from the right speaker 68 to the left ear EL of the listener U. The transfer function CR of the cross talk canceling section 62 is expressed by—HRO/HRS, whereas the transfer function CL of the cross talk canceling section 63 is expressed by—HLO/HLS.

The left collected sound signal SLin is made to pass through the cross talk canceling section 62 and input to the adder 64 as canceling signal. Similarly, the right collected sound signal SRin is made to pass through the cross talk canceling section 63 and input to the adder 61 as canceling signal.

The adder 61 adds the input left collected sound signal SLin and the canceling signal from the cross talk canceling section 63 and outputs the sum signal. The output of the adder 61 is supplied to correction block section 65.

The adder 64 adds the input right collected sound signal SRin and the canceling signal from the cross talk canceling section 62 and supplies the sum signal to correction block section 66.

The correction block section 65 is adapted to correct the reproduction system including a left speaker 67 for the left channel. It comprises a correcting section 65*a* for correcting the changes in the characteristics produced by the cross talk canceling section 63 and a speaker correcting section 65*b* for correcting the speaker characteristics. The transfer characteristic of the correcting section 65*a* is expressed by 1/(1−CL·CR). The transfer characteristic of the correcting section 65*b* is expressed by 1/HLS. The output of the correction block section 65 is produced from the canceling filter 51 as left collected sound signal SLout.

The correction block section 66 is adapted to correct the reproduction system including a right speaker 68 for the right channel. It comprises a correcting section 66*a* for correcting the changes in the characteristics produced by the cross talk canceling section 62 and a speaker correcting section 66*b* for correcting the speaker characteristics. The transfer characteristic of the correcting section 66*a* is expressed by 1/(1−CL·CR). The transfer characteristic of the correcting section 66*b* is expressed by 1/HRS. The output of the correction block section 66 is produced from the canceling filter 51 as right collected sound signal SRout.

Then, the left collected sound signal SLout output from the canceling filter 51 is input to the left speaker 67 of the acoustic space for sound reproduction 69 and the right collected sound signal SRout output from the canceling filter 51 is input to the right speaker 68 of the acoustic space for sound reproduction 69. Then, only the left ear sound that corresponds to the left collected sound signal SLin input to the canceling filter 51 is reproduced to the left ear EL of the listener U in the acoustic space for sound reproduction. Similarly, only the right ear sound that corresponds to the right collected sound signal SRin input to the canceling filter 51 is reproduced to the right ear ER of the listener U in the acoustic space for sound reproduction.

While meta-data indicating the properties of the space that is the target space for reproducing sound data are recorded on the recording medium in the acoustic reproduction apparatus 1 of this embodiment along with the sound data of the recording medium in the above description, it is not necessary to record such meta-data on the recording medium.

For example, contents identification codes may be recorded on the recording medium and the meta-data that correspond to the contents identification codes may be recorded in a database on a network.

Figure 8:
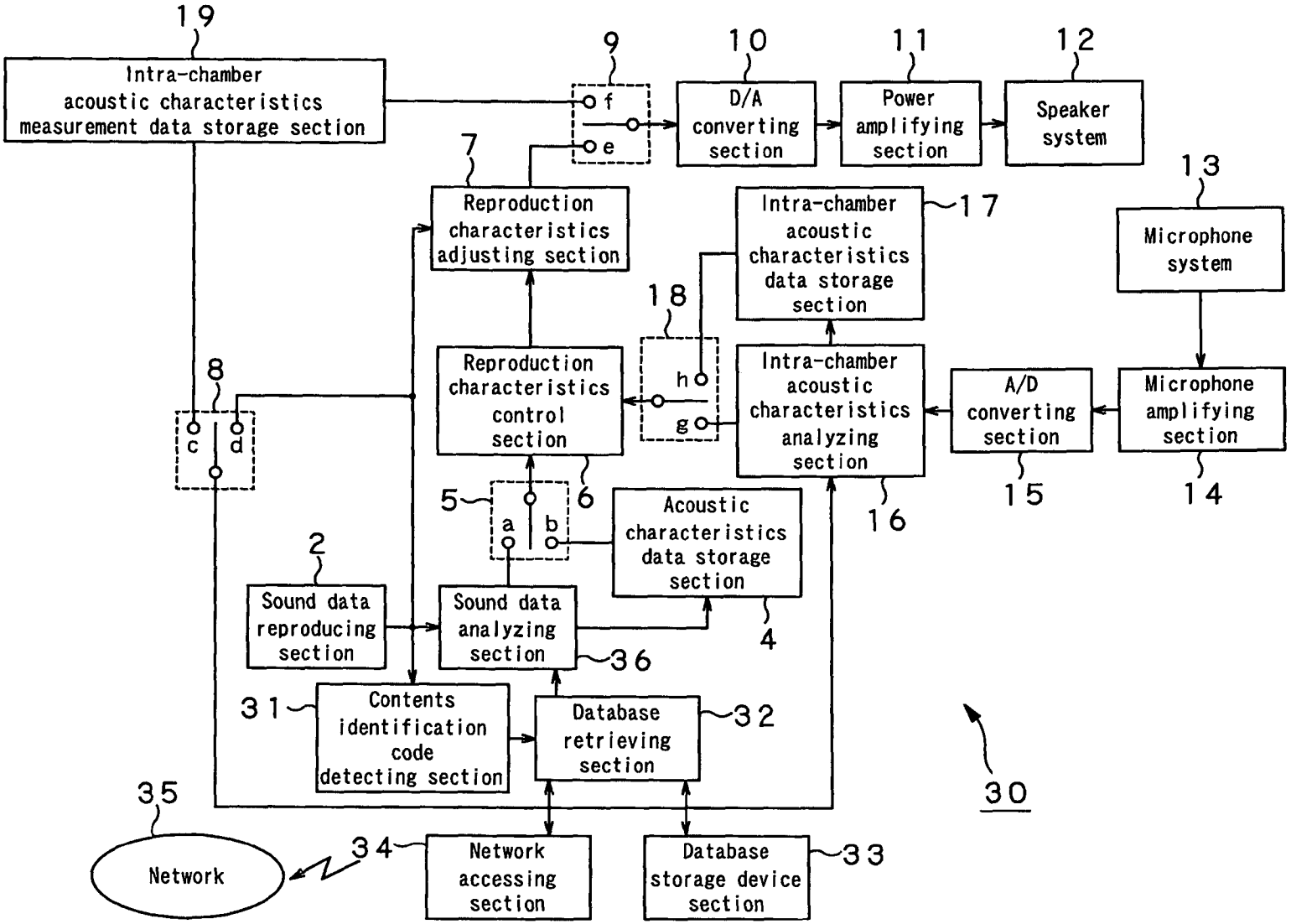
FIG. 8 is a schematic block diagram of another embodiment of reproduction apparatus according to the invention.

Now, another embodiment of reproduction apparatus according to the invention will be described below. This embodiment is so designed as to be suitably used with a recording medium recording contents identification codes and a database on a network storing the meta-data that correspond to the contents identification codes recorded on the recording medium. FIG. 8 is a schematic block diagram of such a reproduction apparatus. The components of the acoustic reproduction apparatus of FIG. 8 that are same as or similar to those of the acoustic reproduction apparatus 1 of FIG. 1 are denoted respectively by the same reference symbols and will not be described any further. Referring now to FIG. 8, the embodiment comprises a contents identification code detecting section 31 for detecting a contents identification code recorded on the recording medium on the basis of the sound data output from the sound data reproducing section 2.

The embodiment also comprises a database retrieving section 32 for reading out the meta-data that correspond to the contents identification code detected by the contents identification code detecting section 31 from the database on the network.

For example, if the contents identification code is already stored in database storage device section 33 of the acoustic reproduction apparatus 30 along with the corresponding meta-data, the database retrieving section 32 reads out the corresponding meta-data from the database storage device section 33.

If, on the other hand, the meta-data that correspond to the detected contents identification code are not stored in the database storage device section 33, the reproduction apparatus controls its network accessing section 34 so as to read the meta-data that correspond to the contents identification code from the database on the network 35 and stores the meta-data along with the contents identification code in the database storage device section 33.

The sound data analyzing section 36 analyzes the meta-data retrieved from the database by the database retrieving section 32 and determines the acoustic characteristics of the studio that are suitable for reproducing the sound data of the recording medium.

Since an acoustic reproduction apparatus 30 having the above described configuration can adjust the acoustic characteristics of the reproduced sound data on the basis of the intra-chamber acoustic characteristics of the studio 20 and the meta-data that correspond to the sound data recorded on the recording medium, it is possible to automatically adjust the acoustic characteristics so as to make them suitable for the specific music source even when different music sources that are different from each other in terms of genre and recording environment are reproduced by the acoustic reproduction apparatus 30.

The contents identification code for identifying the sound data recorded on a recording medium may not necessarily be recorded for identifying specific contents. For example, a part of the TOC data or the music signal data on a compact disc that shows a combination of numerical values with a very low probability of existence of a same combination may alternatively be used as contents identification code.

Now, a reproduction system comprising a plurality of acoustic reproduction apparatus 30 as shown in FIG. 8 will be described below. It is assumed here that, in this reproduction system, an acoustic reproduction apparatus 30 is arranged in a studio (to be referred to as first studio hereinafter) and another acoustic reproduction apparatus 30 is arranged in another studio (to be referred to as second studio hereinafter) that is located at a place different from the first studio and connected to the acoustic reproduction apparatus 30 in the first studio by way of a network. Also assume that the performer in the first studio and the performer in the second studio perform together in a session, utilizing the reproduction system.

The acoustic reproduction apparatus 30 arranged in the first studio (to be referred to as first reproduction apparatus hereinafter) collects the performance of the performer in the first studio and transmits the collected acoustic data to the second studio by way of the network. On the other hand, the acoustic reproduction apparatus 30 arranged in the second studio (to be referred to as second reproduction apparatus hereinafter) collects the performance of the performer in the second studio and transmits the collected acoustic data to the first studio by way of the network.

The first reproduction apparatus supplies the acoustic data supplied from the second reproduction apparatus to the reproduction characteristics adjusting section 7 by way of the sound data reproducing section 2. Additionally, the acoustic characteristics of the second studio provided from the second reproduction apparatus are supplied to the sound data analyzing section 36. Note that it may alternatively be so arranged that the first reproduction apparatus detects the acoustic characteristics of the second studio from the database storage device section 33 or from the network by way of the network accessing section 34.

The first reproduction apparatus controls the reproduction characteristics adjusting section 7 by means of the reproduction characteristics control section 6 on the basis of the acoustic characteristics of the second studio supplied from the changeover switch 5 and the acoustic characteristics of the first studio supplied by way of the changeover switch 18. The reproduction characteristics control section 6 converts the acoustic characteristics of the first studio into inverse characteristics and supplies them to the reproduction characteristics adjusting section 7. The reproduction characteristics control section 6 also generates pseudo reflected sounds and/or pseudo reverberated sounds on the basis of the acoustic characteristics of the second studio and supplies them to the reproduction characteristics adjusting section 7.

The reproduction characteristics adjusting section 7 adjusts the acoustic data collected in the second studio and supplied from the sound data reproducing section 2 on the basis of the acoustic characteristics of the inverse characteristics of the first studio and adds the pseudo reflected sounds and/or the pseudo reverberated sounds supplied from the reproduction characteristics control section 6 to the adjusted acoustic data. The acoustic data output form the reproduction characteristics adjusting section 7 are output to the first studio by way of the changeover switch 9, the D/A converting section 1O, the power amplifying section 11 and the speaker system 12.

Thus, the acoustic characteristics of the first studio are cancelled in the first studio and acoustic data are output according to the acoustic characteristics of the second studio. Therefore, the performer in the first studio can get a live sensation and feels as if he or she were performing in the second studio with the other performer in the second studio.

The second reproduction apparatus arranged in the second studio also processes the acoustic data supplied from the first studio like the first reproduction apparatus. Therefore, the performer in the second studio can get a live sensation and feels as if he or she were performing in the first studio with the other performer in the first studio.

Therefore, in a reproduction system according to the invention and comprising reproduction apparatus also according to the invention, the acoustic characteristics and the characteristics of the acoustic space of the first studio and those of the second studio can mutually be exchanged. Thus, it is possible to provide an acoustic space to the performers in the two studios that makes them able to get a live sensation and feel as if they were performing together in a same studio.

A reproduction system according to the invention may be so arranged as to mutually exchange the acoustic characteristics of the first studio and those of the third studio and also mutually exchange the acoustic characteristics of the third studio and those of the second studio. With such an arrangement, it is possible to make both the performer in the first studio and the performer in the second studio get a live sensation and feel as if they were performing together in the third studio.

Figure 9:
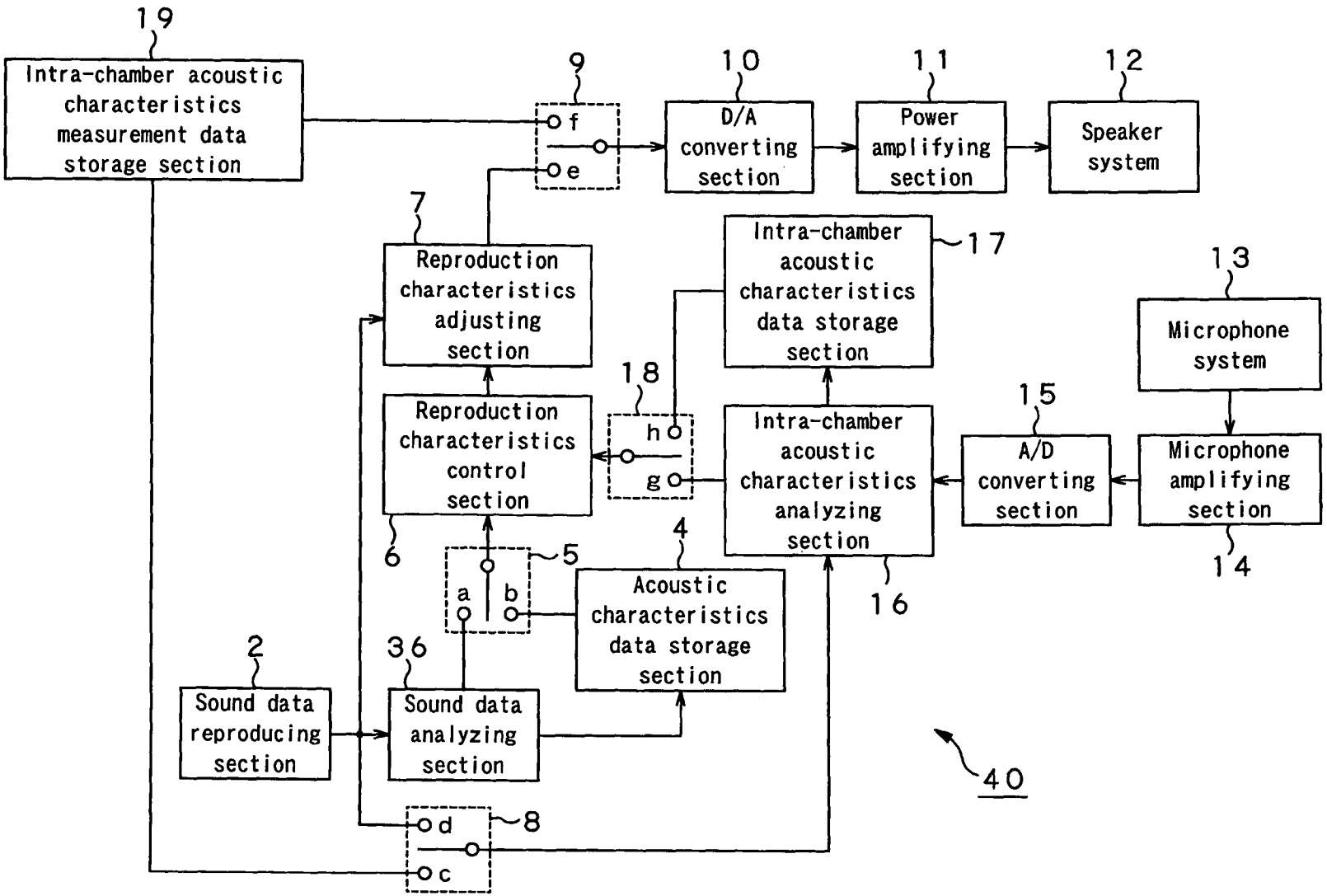
FIG. 9 is a schematic block diagram of still another embodiment of reproduction apparatus according to the invention.

FIG. 9 is a schematic block diagram of still another embodiment of reproduction apparatus according to the invention. The components of the reproduction apparatus of FIG. 9 that are same as or similar to those of the reproduction apparatus of FIG. 1 and those of the reproduction apparatus of FIG. 8 are denoted respectively by the same reference symbols and will not be described any further.

Referring now to FIG. 9, the sound data analyzing section 36 of the acoustic reproduction apparatus 40 is adapted to analyze the properties of the sound data reproduced by the sound data reproducing section 2 and the acoustic space where the sound data are recorded or the intra-chamber acoustic characteristics of a virtual acoustic space where the music data would be produced by a performance.

For example, it typically analyzes the timing and the magnitude of a reflected sound from the profile of auto-correlation function or that of the cepstrum of a sound signal and also the spread of a sound image from the inter-channel cross-correlation function.

The sound data analyzing section 36 is preferably provided with the function of a band dividing filter so that it may be able to divide a frequency band and structurally analyze a reflected sound when analyzing sound data.

The outcome of the analysis of the sound data analyzing section 36 may be stored in the sound characteristics data storage section 4 typically for each contents identification code so that the contents identification code of the corresponding contents may be retrieved each time the contents are selected.

Since an acoustic reproduction apparatus 40 having the above described configuration can adjust the acoustic characteristics of the reproduced sound data on the basis of the intra-chamber acoustic characteristics of the studio 20 and acoustic characteristics of the sound data obtained from the sound data recorded on a recording medium, it is possible to automatically adjust the acoustic characteristics so as to make them suitable for the specific music source even when different music sources that are different from each other in terms of genre and recording environment are reproduced by the reproduction apparatus.

The present invention is by no means limited to the configurations of the above-described embodiments. In other words, a reproduction apparatus according to the invention may have any other configuration so long as it is adapted to adjust acoustic characteristics on the basis of the acoustic characteristics of the data to be reproduced from a recording medium and the intra-chamber acoustic characteristics of a studio.

While the recording medium is an optical disc in each of the above described embodiments, the present invention is by no means limited thereto and the recording medium may alternatively be a disc of the blu-ray system, a disc of the CD (compact disc) system, a mini disc, an HDD (hard disc drive), a memory card such as that of a flash memory or a recording medium of some other type.

It should be understood by those skilled in the art that various modifications, combinations, sub-combinations and alternations may occur depending on design requirements and other factors insofar as they are within the scope of the appended claims or the equivalents thereof.

What is claimed is:

1. A reproduction apparatus comprising:

inverse characteristics conversion means for converting the acoustic characteristics of an acoustic space into inverse characteristics thereof;

reproduction means for reproducing music data;

acoustic characteristics output means for outputting acoustic characteristics different from the acoustic characteristics of the acoustic space;

adjustment means for adjusting the music data reproduced by the reproduction means on the basis of the inverse acoustic characteristics of the acoustic space converted by the inverse characteristics conversion means and the acoustic characteristics output from the acoustic characteristics output means; and output means for outputting the music data adjusted by the adjustment means to the acoustic space, wherein the adjustment means calculates a first transfer function (HLS) corresponding to a route from a left speaker of the output means to a left ear of a person in the acoustic space, a second transfer function (HLO) corresponding to a route from the left speaker of the output means to a right ear of the person in the acoustic space, a third transfer function (HRO) corresponding to a route from a right speaker of the output means to the left ear of the person in the acoustic space, and a fourth transfer function (HRS) corresponding to a route from the right speaker of the output means to the right ear of the person in the acoustic space, and the adjustment means adjusts the music data output from the left and right speakers of the output means by inputting a received signal corresponding to the left speaker to a first cross-talk cancelling section having a transfer function (CR) expressed by—HRO/HRS and adding an output of the first cross-talk cancelling section to a received signal corresponding to the right speaker, and by inputting the received signal corresponding to the right speaker to a second cross-talk cancelling section having a transfer function (CL) expressed by—HLO/HLS and adding an output of the second cross-talk cancelling section to the received signal corresponding to the left speaker.

2. The apparatus according to claim 1, wherein the adjustment means is adapted to add pseudo reflected sounds and/or pseudo reverberated sounds conforming to the acoustic characteristics output by the acoustic characteristics output means to the music data reproduced by the reproduction means.

3. The apparatus according to claim 1, further comprising:

measurement signal generation means for generating a predetermined measurement signal;

a microphone that detects the signal output to the acoustic space, the signal being generated by the measurement signal generation means and output to the acoustic space by way of the output means; and acoustic characteristics generation means for generating acoustic characteristics of the acoustic space on the basis of the signal detected by the microphone and the signal generated by the measurement signal generation means;

the inverse characteristics conversion means being adapted to convert the acoustic characteristics generated by the acoustic generation means into inverse characteristics.

4. The apparatus according to claim 1, further comprising:

a microphone that detects the music data output to the acoustic space, the music data being reproduced by the reproduction means and output to the acoustic space by the way of the output means; and acoustic characteristics generation means for generating acoustic characteristics of the acoustic space on the basis of the music data detected by the microphone and the music data reproduced by the reproduction means;

the inverse characteristics conversion means being adapted to convert thee acoustic characteristics generated by the acoustic characteristics generation means into inverse characteristics.

5. The apparatus according to claim 1, further comprising:

a database storing a plurality of sets of acoustic characteristics different from that of the acoustic space; and read means for reading out a set of acoustic characteristics from the database on the basis of the music data reproduced by the reproduction means;

the adjustment means being adapted to adjust the music data reproduced by the reproduction means on the basis of the inverse acoustic characteristics of the acoustic space obtained by conversion by the inverse characteristics conversion means and the set of acoustic characteristics read out by the read means.

6. The apparatus according to claim 5, wherein the database is connected to the reproduction apparatus by way of a network.

7. The apparatus according to claim 1, wherein the adjustment means adjusts the music data output from the left and right speakers of the output means by inputting the added output of the first cross-talk cancelling section and the received signal corresponding to the right speaker to a first correction block having a sequential plurality of transfer functions expressed by $1/(1-CL \cdot CR)$ and 1/HRS, and by inputting the added output of the second cross-talk cancelling section and the received signal corresponding to the left speaker to a second correction block having a sequential plurality of transfer functions expressed by $1/(1-CL \cdot CR)$ and 1/HLS.

8. A reproduction system comprising a first reproduction apparatus arranged in an acoustic space and a second reproduction apparatus arranged in another acoustic space and connected to the first reproduction apparatus by way of a network, the first reproduction apparatus including:

first inverse characteristics conversion means for converting the acoustic, characteristics of an acoustic space into inverse characteristics thereof;

first reproduction means for reproducing the music data supplied from the second reproduction apparatus by way of the network;

first acoustic characteristics output means for outputting acoustic characteristics different from the acoustic characteristics of the acoustic space;

first adjustment means for adjusting the music data reproduced by the first reproduction means on the basis of the inverse acoustic characteristics of the acoustic space converted by the first inverse characteristics conversion means and the acoustic characteristics output from the first acoustic characteristics output means;

first output means for outputting the music data adjusted by the first adjustment means to the acoustic space, wherein the first adjustment means calculates a first transfer function (HLS) corresponding to a route from a left speaker of the output means to a left ear of a person in the acoustic space, a second transfer function (HLO) corresponding to a route from the left speaker of the output means to a right ear of the person in the acoustic space, a third transfer function (HRO) corresponding to a route from a right speaker of the output means to the left ear of the person in the acoustic space, and a fourth transfer function (HRS) corresponding to a route from the right speaker of the output means to the right ear of the person in the acoustic space, and the first adjustment means adjusts the music data output from the left and right speakers of the first output means by inputting a received signal corresponding to the left speaker to a first cross-talk cancelling section having a transfer function (CR) expressed by—HRO/HRS and adding an output of the first cross-talk cancelling section to a received signal corresponding to the right speaker, and by inputting the received signal corresponding to the right speaker to a second cross-talk cancelling section having a transfer function (CL) expressed by—HLO/HLS and adding an output of the second cross-talk cancelling section to the received signal corresponding to the left speaker;

first sound collecting means for collecting the music data output from the first output means; and first supply means for supplying the music data collected by the first sound collecting means to the second reproduction apparatus by way of the network, the second reproduction apparatus including:

second inverse characteristics conversion means for converting the acoustic characteristics of another acoustic space into inverse characteristics thereof;

second reproduction means for reproducing the music data supplied from the first reproduction apparatus by way of the network;

second acoustic characteristics output means for outputting acoustic characteristics different from the acoustic characteristics of the other acoustic space;

second adjustment means for adjusting the music data reproduced by the second reproduction means on the basis of the inverse acoustic characteristics of the other acoustic space converted by the second inverse characteristics conversion means and the acoustic characteristics output from the second acoustic characteristics output means;

second output means for outputting the music data adjusted by the second adjustment means to the other acoustic space;

second sound collecting means for collecting the music data output from the second output means; and second supply means for supplying the music data collected by the second sound collecting means to the first reproduction apparatus by way of the network.

9. The system according to claim 8, wherein the first adjustment means is adapted to add pseudo reflected sounds and/or pseudo reverberated sounds conforming to the acoustic characteristics output by the first acoustic characteristics output means to the music data reproduced by the first reproduction means; and the second adjustment means is adapted to add pseudo reflected sounds and/or pseudo reverberated sounds conforming to the acoustic characteristics output by the second acoustic characteristics output means to the music data reproduced by the second reproduction means.

10. The system according to claim 8, wherein the first reproduction apparatus further includes:

first measurement signal generation means for generating a predetermined measurement signal;

a first microphone that detects the signal output to the acoustic space, the signal being generated by the first measurement signal generation means and output to the acoustic space by way of the first output means; and first acoustic characteristics generation means for generating acoustic characteristics of the acoustic space on the basis of the signal detected by the first microphone and the signal generated by the first measurement signal generation means;

the first inverse characteristics conversion means being adapted to convert the acoustic characteristics generated by the first acoustic characteristics generation means into inverse characteristics, and the second reproduction apparatus further includes:

second measurement signal generation means for generating a predetermined measurement signal;

a second microphone that detects the signal output to the other acoustic space, the signal being generated by the second measurement signal generation means and output to the other acoustic space by way of the second output means; and second acoustic characteristics generation means for generating acoustic characteristics of the other acoustic space on the basis of the signal detected by the second microphone and the signal generated by the second measurement signal generation means;

the second inverse characteristics conversion means being adapted to convert the acoustic characteristics generated by the second acoustic characteristics generation means into inverse characteristics.

11. The system according to claim 8, wherein the first reproduction apparatus further includes:

a first microphone that detects the music data output to the acoustic space, the music data being reproduced by the first reproduction means and output to the acoustic space by the way of the first output means;

first acoustic characteristics generation means for generating acoustic characteristics of the acoustic space on the basis of the music data detected by the first microphone and the music data reproduced by the first reproduction means;

the first inverse characteristics conversion means being adapted to convert the acoustic characteristics generated by the first acoustic generation means into inverse characteristics, and the second reproduction apparatus further includes:

a second microphone that detects the music data output to the other acoustic space, the music data being reproduced by the second reproduction means and output to the other acoustic space by the way of the second output means;

second acoustic characteristics generation means for generating acoustic characteristics of the other acoustic space on the basis of the music data detected by the second microphone and the music data reproduced by the second reproduction means;

the second inverse characteristics conversion means being adapted to convert the acoustic characteristics generated by the second acoustic characteristics generation means into inverse characteristics.

12. The system according to claim 8, wherein the first reproduction apparatus further includes:

a first database that stores a plurality of sets of acoustic characteristics different from that of the acoustic space; and first read means for reading out a set of acoustic characteristics from the first database on the basis of the music data reproduced by the first reproduction means;

the first adjustment means being adapted to adjust the music data reproduced by the first reproduction means on the basis of the inverse acoustic characteristics of the acoustic space obtained by conversion by the first inverse characteristics conversion means and the set of acoustic characteristics read out by the first read means, and the second reproduction apparatus further includes:

a second database that stores a plurality of sets of acoustic characteristics different from that of the other acoustic space; and second read means for reading out a set of acoustic characteristics from the second database on the basis of the music data reproduced by the second reproduction means;

the second adjustment means being adapted to adjust the music data reproduced by the second reproduction means on the basis of the inverse acoustic characteristics of the other acoustic space obtained by conversion by the second inverse characteristics conversion means and the set of acoustic characteristics read out by the second read means.

13. The system according to claim 8, wherein the first database and the second database are connected respectively to the first and second reproduction apparatus by way of a network.

14. The system according to claim 8, wherein the first adjustment means adjusts the music data output from the left and right speakers of the first output means by inputting the added output of the first cross-talk cancelling section and the received signal corresponding to the right speaker to a correction block having a sequential plurality of transfer functions expressed by 1/(1−CL·CR) and 1/HRS, and by inputting the added output of the second cross-talk cancelling section and the received signal corresponding to the left speaker to a correction block having a sequential plurality of transfer functions expressed by 1/(1−CL·CR) and 1/HLS.

15. A reproduction apparatus comprising:

an inverse characteristics conversion section that converts the acoustic characteristics of an acoustic space into inverse characteristics thereof;

a reproduction section that reproduces music data;

an acoustic characteristics output section that outputs acoustic characteristics different from the acoustic characteristics of the acoustic space;

an adjustment section that adjusts the music data reproduced by the reproduction section on the basis of the inverse acoustic characteristics of the acoustic space converted by the inverse characteristics conversion section and the acoustic characteristics output from the acoustic characteristics output section; and an output section that outputs the music data adjusted by the adjustment section to the acoustic space, wherein the adjustment section is configured to calculate a first transfer function (HLS) corresponding to a route from a left speaker of the output means to a left ear of a person in the acoustic space, a second transfer function (HLO) corresponding to a route from the left speaker of the output means to a right ear of the person in the acoustic space, a third transfer function (HRO) corresponding to a route from a right speaker of the output means to the left ear of the person in the acoustic space, and a fourth transfer function (HRS) corresponding to a route from the right speaker of the output means to the right ear of the person in the acoustic space, and the adjustment section is configured to adjust the music data output from the left and right speakers of the output section by inputting a received signal corresponding to the left speaker to a first cross-talk cancelling section having a transfer function (CR) expressed by—HRO/HRS and adding an output of the first cross-talk cancelling section to a received signal corresponding to the right speaker, and by inputting the received signal corresponding to the right speaker to a second cross-talk cancelling section having a transfer function (CL) expressed by—HLO/HLS and adding an output of the second cross-talk cancelling section to the received signal corresponding to the left speaker.

16. The apparatus of claim 15, wherein the adjustment section is configured to adjust the music data output from the left and right speakers of the output section by inputting the added output of the first cross-talk cancelling section and the received signal corresponding to the right speaker to a first correction block having a sequential plurality of transfer functions expressed by 1/(1−CL·CR) and 1/HRS, and by inputting the added output of the second cross-talk cancelling section and the received signal corresponding to the left speaker to a second correction block having a sequential plurality of transfer functions expressed by 1/(1−CL·CR) and 1/HLS.

17. A reproduction system comprising a first reproduction apparatus arranged in an acoustic space and a second reproduction apparatus arranged in another acoustic space and connected to the first reproduction apparatus by way of a network, the first reproduction apparatus including:

a first inverse characteristics conversion section that converts the acoustic characteristics of an acoustic space into inverse characteristics thereof;

a first reproduction section that reproduces the music data supplied from the second reproduction apparatus by way of the network;

a first acoustic characteristics output section that outputs acoustic characteristics different from the acoustic characteristics of the acoustic space;

a first adjustment section that adjusts the music data reproduced by the first reproduction section on the basis of the inverse acoustic characteristics of the acoustic space converted by the first inverse characteristics conversion section and the acoustic characteristics output from the first acoustic characteristics output section;

a first output section that outputs the music data adjusted by the first adjustment section to the acoustic space, wherein the first adjustment section is configured to calculate a first transfer function (HLS) corresponding to a route from a left speaker of the output means to a left ear of a person in the acoustic space, a second transfer function (HLO) corresponding to a route from the left speaker of the output means to a right ear of the person in the acoustic space, a third transfer function (HRO) corresponding to a route from a right speaker of the output means to the left ear of the person in the acoustic space, and a fourth transfer function (HRS) corresponding to a route from the right speaker of the output means to the right ear of the person in the acoustic space, and the adjustment section is configured to adjust the music data output from the left and right speakers of the first output section by inputting a received signal corresponding to the left speaker to a first cross-talk cancelling section having a transfer function (CR) expressed by—HRO/HRS and adding an output of the first cross-talk cancelling section to a received signal corresponding to the right speaker, and by inputting the received signal corresponding to the right speaker to a second cross-talk cancelling section having a transfer function (CL) expressed by—HLO/HLS and adding an output of the second cross-talk cancelling section to the received signal corresponding to the left speaker;

a first sound collecting section that collects the music data output from the first output section; and a first supply section that supplies the music data collected by the first sound collecting section to the second reproduction apparatus by way of the network, the second reproduction apparatus including:

a second inverse characteristics conversion section that converts the acoustic characteristics of another acoustic space into inverse characteristics thereof;

a second reproduction section that reproduces the music data supplied from the first reproduction apparatus by way of the network;

a second acoustic characteristics output section that outputs acoustic characteristics different from the acoustic characteristics of the other acoustic space;

a second adjustment section that adjusts the music data reproduced by the second reproduction section on the basis of the inverse acoustic characteristics of the other acoustic space converted by the second inverse characteristics conversion section and the acoustic characteristics output from the second acoustic characteristics output section;

a second output section that outputs the music data adjusted by the second adjustment section to the other acoustic space;

a second sound collecting section that collects the music data output from the second output section; and a second supply section that supplies the music data collected by the second sound collecting section to the first reproduction apparatus by way of the network.

18. The system of claim 17, wherein the first adjustment section is configured to adjust the music data output from the left and right speakers of the first output section by inputting the added output of the first cross-talk cancelling section and the received signal corresponding to the right speaker to a first correction block having a sequential plurality of transfer functions expressed by 1/(1−CL·CR) and 1/HRS, and by inputting the added output of the second cross-talk cancelling section and the received signal corresponding to the left speaker to a second correction block having a sequential plurality of transfer functions expressed by 1/(1−CL·CR) and 1/HLS.

* * * * *